United States Patent [19]

Halfhide

[11] Patent Number: 5,010,831

[45] Date of Patent: Apr. 30, 1991

[54] PARTICULATE FUEL BURNER AND METHOD OF OPERATION

[76] Inventor: Frans L. Halfhide, Binnenpolder 17, NL-1112 RW Diemen, Netherlands

[21] Appl. No.: 427,118

[22] PCT Filed: Apr. 18, 1988

[86] PCT No.: PCT/NL88/00017

§ 371 Date: Oct. 18, 1989

§ 102(e) Date: Oct. 18, 1989

[87] PCT Pub. No.: WO88/08505

PCT Pub. Date: Nov. 3, 1988

[30] Foreign Application Priority Data

Apr. 21, 1987 [NL] Netherlands ..... 8700945

[51] Int. Cl.[5] ..... F23D 1/00

[52] U.S. Cl. ..... 110/347; 110/102; 110/110; 110/229; 110/346; 110/257

[58] Field of Search ..... 110/110, 233, 229, 235, 110/242, 246, 255, 257, 260, 102, 346, 347

[56] References Cited

U.S. PATENT DOCUMENTS

| | | | |
|---|---|---|---|
| 4,361,100 | 11/1982 | Hinger | 110/110 X |
| 4,470,358 | 9/1984 | Prochnow . | |
| 4,593,629 | 6/1986 | Pedersen et al. | 110/110 X |
| 4,782,765 | 11/1988 | Miller et al. | 110/110 X |
| 4,856,438 | 8/1989 | Peugh | 110/233 |

FOREIGN PATENT DOCUMENTS

| | | |
|---|---|---|
| 2608559 | 9/1977 | Fed. Rep. of Germany . |
| 2622930 | 12/1977 | Fed. Rep. of Germany . |
| 1590341 | 6/1981 | United Kingdom . |

*Primary Examiner*—Edward G. Favors

*Attorney, Agent, or Firm*—Young & Thompson

[57] ABSTRACT

Burner having two coaxially mounted tubes (3,4). The outer tube (3) is provided with means to introduce both air and particulate matter in the space between both tubes. For conveying of solid matter between both tubes screw conveyor means (5) are provided. Transferring of gasses resulting from gasification of the solid material to the inner space of the inner tube 4 is provided by opening (15).

8 Claims, 2 Drawing Sheets

PARTICULATE FUEL BURNER AND METHOD OF OPERATION

DESCRIPTION

Figure 1:
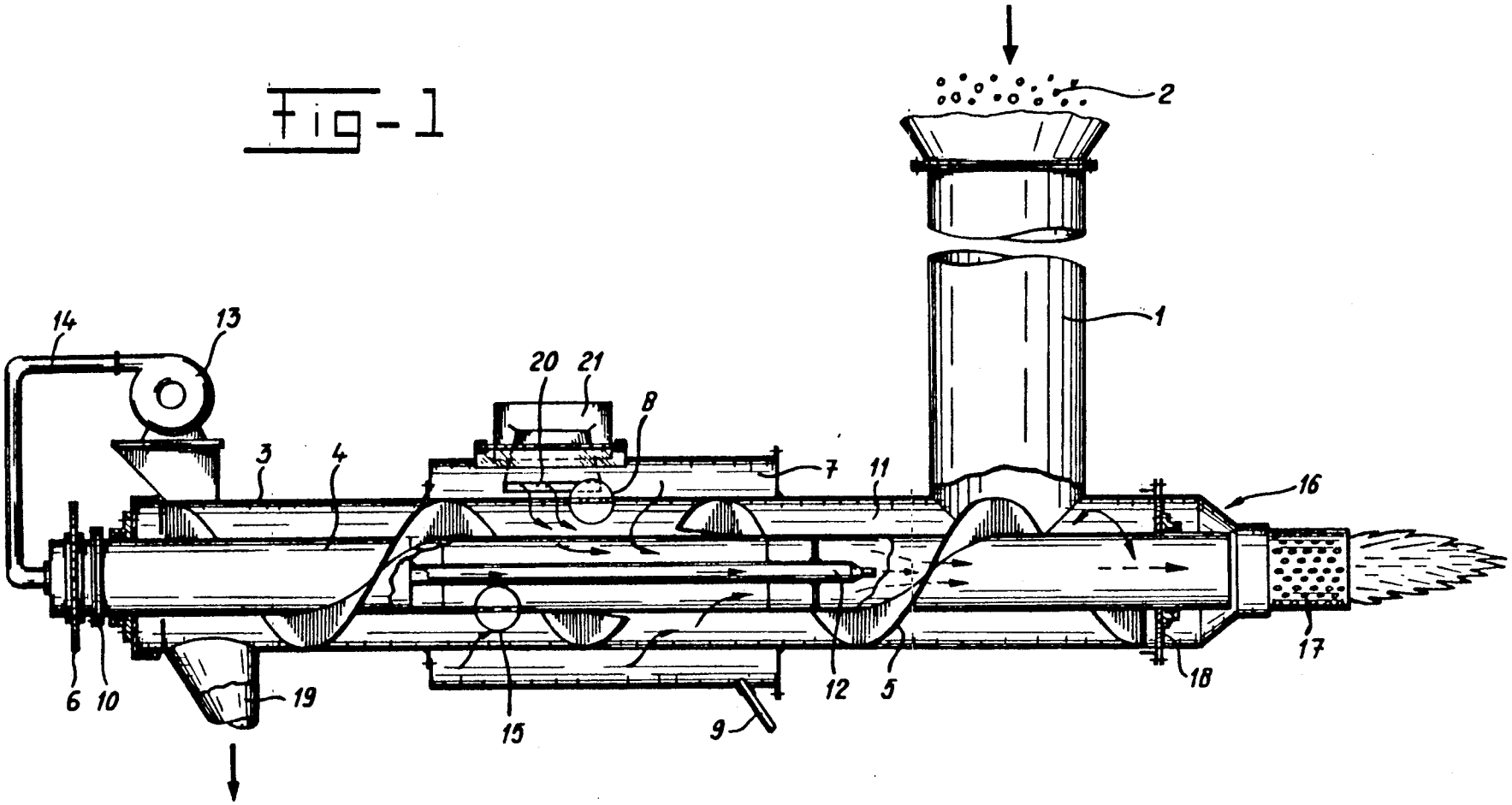

This invention relates to a burner comprising two coaxially mounted tubes, provided with means to introduce air as well as particulate matter in the space between both tubes and means to discharge burnt matter from that space, wherein the inner tube being at least partially gas porous, said inner tube being provided with means to introduce a combustion agent.

Such a burner is known for instance from GB-A-1590341. In the prior art attempts have been made to improve combustion of materials layerwise. At layerwise burning of particular material the draw back exists that the material is not burnt completely. Furthermore the temperature can rise very high such that dangerous fumes can develop which have to be extracted before discharging of the flow. To obviate these problems fluid bed combustion has been proposed, wherein the particulate material is burnt from all sides in a continuous homogenous way. Because of this the material will burn more completely whereas the temperature of combustion will be lower not giving rise to much harmful bits. In GB-A-1590341 it is described that such a fluid bed is maintained by introducing of air. This air keeps the particulate material floating within the combustion space. The space for burning the particles according to this specification has a special disk-like shape. This is necessary to maintain the particles in a fluid state. However, this gives a restriction with regard to the possibilities of constructions of the burner and its capacity. Furthermore it is not possible to fluidize all kinds of materials. Some materials can have such a weight-/volume ratio that it is impossible to fluidize them. Furthermore it is often desirable to burn mixtures of materials, in which the individual components have different specific weight. In using air as fluidizing means a non-uniform distribution is obtained in this case. Although combustion with a fluidized bed is normally much cleaner than other methods for burning it is not possible to prevent that some harmful substances, such as aromatic components are produced.

The invention aims to obviate these drawbacks. This aim is realized in that in the space between both tubes screw conveyor means are provided. According to the invention transport of the material to be burnt is forced through mechanical means, whilst because of the large surface to volume ratio conditions are obtained approaching a fluidized bed. In this way it is possible to burn mixtures of materials having components with different specific weight. It is also possible to burn materials which are difficult to fluidize.

After the material to be burnt is introduced it is preheated by the heat from the inner tube. During heating decomposition occurs. The gaseous part leaves the burner and can directly be burnt or further processed. This gaseous part contains possible harmful components. The solid matters remaining are transported by the screw conveyor means and gasified by air introduced in the burner. The gas resulting from this process (such as CO) is introduced in the inner tube and burnt partially to heat this tube to the fore-mentioned decomposition temperature.

According to a preferred embodiment the screw conveyor means are connected to the inner tube, being rotatably suspended. In this manner a very simple embodiment of the burner according to the invention can be realised. To transfer gaseous products being formed in the space between the inner and outer tube and which are not completely burnt, filter openings can be comprised in the inner tube. For optimizing the combustion a vacuum air injection member can be provided. The burner can be provided with air with a blower introducing air with over-pressure in the space between the two tubes.

According to a further preferred embodiment the means for introducing of air can comprise an air box surrounding at least a part of the outer tube. This outer tube being air permeable and the lower part of the air box is connected to further conveyor means. Particulate material being able to move in the air box can be discharged by the further conveyor means. Preferably these further conveyor means are also used to discharge burnt matter from the space between the tubes.

The heat resulting from the combustion can be used for all kinds of applications. The ashes being discharged can also be further proceeded. For instance it is possible to mix the ashed resulting from combustion of rice husk with sodiumsilicate (tumbler) or clay and to cure the prepared product in a furnace. This furnace can be heated with energy from the burner according to the invention.

The invention also relates to a method for operating the burner described above, wherein the speed of the conveyor means is such adapted to the nature and quantity of material introduced, that substantial all solid (partially burnt) particles are conveyed by it.

Figure 2:
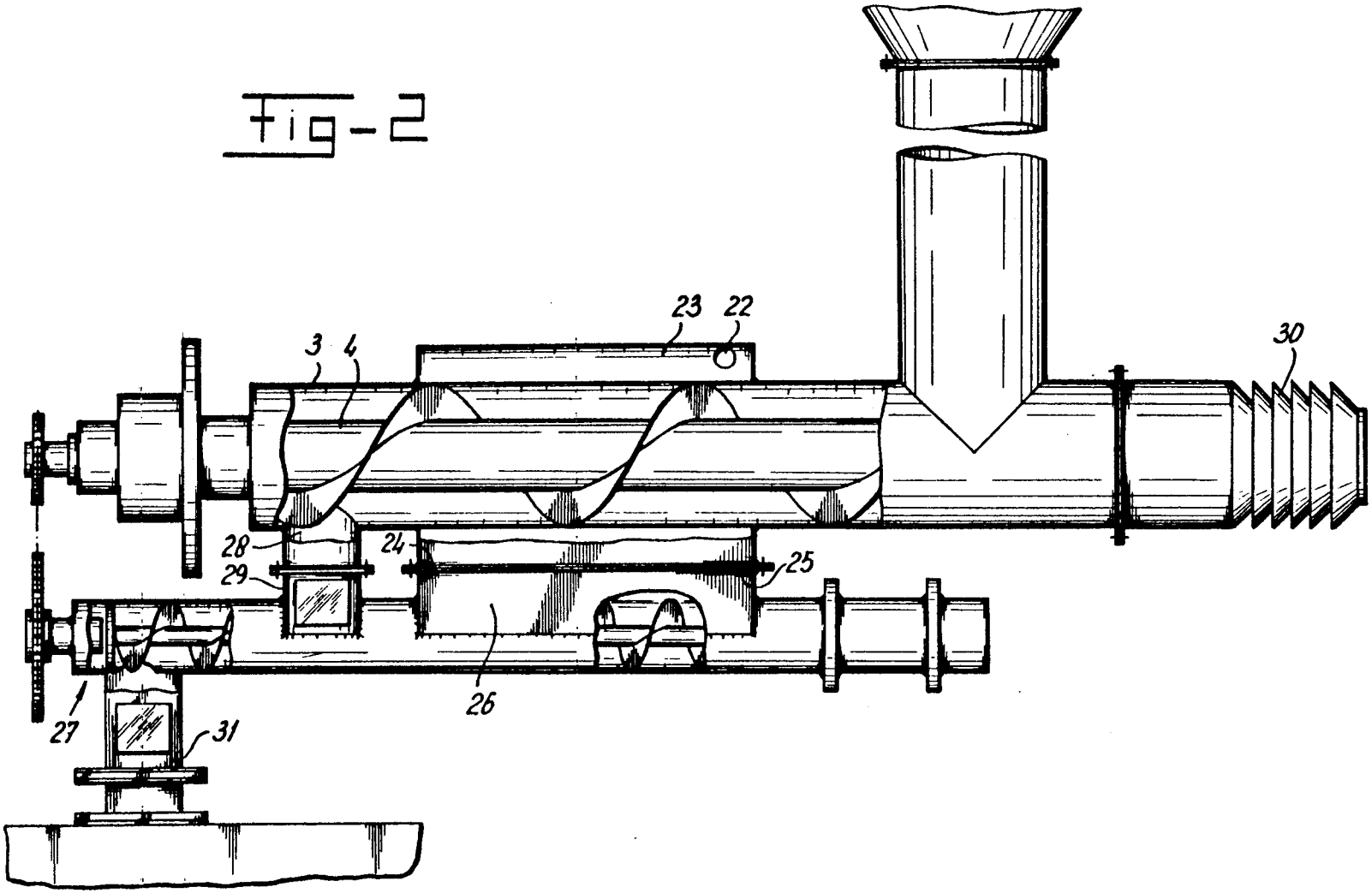

The invention will now be described more detailed referring to two embodiments as examples shown in the drawing wherein:

FIG. 1 shows a side elevation, partially exploded, of a first embodiment of the burner according to the invention and FIG. 2 shows a side elevation, partially exploded, of a further embodiment according to the invention.

The burner shown in FIG. 1 comprises a feed hopper 1 for solid fuel 2 such as rice husk. This feed hopper is connected to outer tube 3. Within said outer tube 3 inner tube 4 is arranged. Around inner tube 4 a screw conveyor 5 is arranged, being fixed to the inner tube 4. The inner tube 4 is rotatably driven with a gear wheel 6 through transmission means (not shown). Around outer tube 3 box 7 is provided, being connected through filter 8 with space 11 between outer tube 3 and inner tube 4. Furthermore supply means 9 are provided in box 7 for supplying of fuel for initiating or maintaining the combustion. Air supply from the outer tube 3 is realized by an opening 20 of the blower 21 being connected to the box and introducing suctioned air with over-pressure to the internal of the outer tube. To seal space 11 from the atmosphere sealing means 10 are provided. Within inner tube 2 air injector 12 is provided. This injector is provided with combustion air through blower 13 and tubing 14. The inner tube 4 is provided with a porous section at 15. Both filter 8 and section 15 can comprise a number or openings arranged in the corresponding tube wall. For optimised operation the axis of these openings preferably extend with an angle of 40° with regard to the axis of subject tube. The outer tube 3 is tapered at its right side 16 and is provided with openings 17 for final combustion. Furthermore a porous wall is provided at 18.

During operation the burner functions as follows: solid fuel 2 is introduced in space 11 through feed hopper 1 and transported by conveyor 5. In space 11 combustion is initiated for instance by gas through supply 9 wherein air is introduced in box 7 with over-pressure through opening 20 by blower 21. Combustion is controlled in such a way that partially burnt gaseous products as CO and ashes results, which are bonded with remaining carbon in such a way that they are coherent preventing decomposition by sub-pressure effect. The completely burnt ashes are discharged at 19 as fly ash. The gaseous products being partially burnt are together with air from box 7 passed through filter 15 in inner tube 4. This air is entrained by suctioning arising in that from air injector 12 air emanates being pressurized by blower 13. In this way the final "clean" burning of the gaseous products introduced in space 11 occurs. Heat generated during combustion in the inner tube is partially transferred to the material entering space 11, such that this material can be ignited more easily. The gases leaving the inner tube will entrain gas products resulting from the pre-combustion in the outer tube through the porous wall 18 by its velocity. These waste gases still comprising components which can be burnt, are burnt at 17, such that optimized efficiency of the burner results. The temperature in space 11 will vary between 600° en 700° C. when rice husk is used, whilst the final temperature of the flame at 16 is dependent on the air supply by blower 13. By correctly adjusting of the supply of air and fuel to the burner continuous combustion can be obtained, wherein no introduction of combustion supporting fuel through conduit 9 is not necessary.

Using of the conveyor means prevents solid particles to leave the burner through 17. In this way it can be prevented that harmful substances are formed at 17. The partially burnt particles are conveyed by the screw conveyor and in box 17 they are gasified. The resulting gases comprising CO are introduced in the inner tube 4 and burnt giving clean gases. The remaining solids are discharged at 19.

In FIG. 2 a further example of the burner according to the invention is shown. Basically the top half of FIG. 2 is the same as shown in FIG. 1. In this embodiment air is supplied through conduit 22 in box 23. At its lower end box 23 is provided with flange 24 connected with flange 25 of stud 26 of a further conveyor 27. Discharge opening 28 is also connected to this further conveyor 27 through stud 29. This further conveyor 27 is provided to assure discharging of the ash products from discharge 28. To prevent particulate material ingressing through the porous openings in outer tube 3 entering box 23 to accumulate, communication with further conveyor 27 is provided. To this conveyor a further discharge 31 is connected which can communicate with all conveyor means known in the art. In FIG. 2 also means 30 are provided for final combustion of the products leaving the upper part of the burner.

Except from injecting of air through nozzle 12 it is also possible to introduce calcium for binding of sulphur being present in the material to be burnt.

The applicability of this burner is considerable. For instance during growing of rice only 37,5% by weight is used for consumption, whilst the other material such as rice husk and straw was up to now seen as waste because it is difficult to burn. However, with the burner according to subject invention this material can be easily burned and is useful. By burning in at least two steps and forced transport of material the advantages of both fluidized bed and layer like combustions are combined. If carbon being present in the rice husk would be directly burnt to carbon dioxide the temperature can rise to more than 800° C., during which process silicon products can be formed as harmful sub products. The complete combustion of carbon in two separate steps in inner tube 4 and burner 17 keeps the temperature of combustion low during the first step whilst complete burning to non harmful substances can be assured.

Although the embodiments shown above are preferred at the time being, it will be understood by the person skilled in the art that many obvious variations can be realized. It is furthermore also possible to integrate the burner in different kinds of processes, where the heat and/or material resulting from the burner can play a useful role.

I claim:

1. Burner comprising two coaxially mounted tubes provided with means to introduce air as well as particulate matter in the space between both tubes and means to discharge burnt matter from that space and wherein the inner tube being at least partially gas porous, said inner tube being provided with means to introduce a combustion agent, characterized in that, in the space between both tubes screw conveyor means are provided.

2. Burner according to claim 1, wherein the screw conveyor means are connected to the inner tube, being rotatably suspended.

3. Burner according to claim 1, wherein means are provided for transferring of products of incomplete combustion, comprising filter openings in the inner tube.

4. Burner according to claim 1, wherein at least a vacuum air injector member is provided in the inner tube.

5. Burner according to claim 1, wherein means are provided for introducing of air in the space between the tubes with over-pressure.

6. Burner according to claim 1, wherein the means for introducing of air comprise of an air box surrounding at least a part of the outer tube being air permeable, wherein the lower part of the air box being connected to further conveyor means.

7. Burner according to claim 6, wherein the means to discharge burnt matter from the space between the tubes are connected to the further conveyor means.

8. Method for operating a burner comprising two coaxially mounted tubes provided with means to introduce air as well as particulate matter in the space between both tubes and means to discharge burnt matter from that space and wherein the inner tube being at least partially gas porous, said inner tube being provided with means to introduce a combustion agent, characterized in that, in the space between both tubes screw conveyor means are provided, wherein the speed of the conveyor means is so adapted to the nature and quantity of the material introduced that substantially all of the solid (partially burnt) particles are conveyed by it.

* * * * *